United States Patent [19]

Lauren

[11] 3,942,786

[45] Mar. 9, 1976

[54] SHEET LAYING APPARATUS

[75] Inventor: Unto Antero Lauren, 05, Karhula, Finland

[73] Assignee: A. Ahlstrom Osakeyhtio, Finland

[22] Filed: Aug. 9, 1971

[21] Appl. No.: 170,114

[30] Foreign Application Priority Data

Aug. 18, 1970 Finland ..... 2268/70

[52] U.S. Cl. ..... 271/177; 83/88; 271/80; 271/202

[51] Int. Cl.[2] ..... B65H 29/68

[58] Field of Search ..... 271/46, 71, 80, 76, 51; 83/88, 110, 112, 113

[56] References Cited

UNITED STATES PATENTS

| | | | |
|---|---|---|---|
| 2,278,518 | 4/1942 | Kenney et al. | 271/64 |
| 2,655,842 | 10/1953 | Baumgartner | 83/88 X |
| 2,863,663 | 12/1958 | Richards | 271/76 X |
| 3,096,978 | 7/1963 | Jendnusch | 271/46 |
| 3,228,273 | 1/1966 | Huffman | 271/46 X |
| 3,554,534 | 1/1971 | Grody | 271/76 |

*Primary Examiner*—Evon C. Blunk
*Assistant Examiner*—Bruce H. Stoner, Jr.
*Attorney, Agent, or Firm*—Bucknam and Archer

[57] ABSTRACT

After a cutter cutting sheets out of a travelling web has been arranged a pair of drive rollers rotated at a linear velocity at least equal to that of the web. The sheets are thrown by the pair of drive rollers and received and further delivered to a laying station by conveying means operated at a velocity lower than that of the drive rollers so as to cause the sheets to assume a partially overlapping relationship. After the drive rollers there is preferably arranged guide means for forcing the trailing edge of the sheet downward to enable the leading edge of the next sheet freely to pass over said trailing end.

1 Claim, 3 Drawing Figures

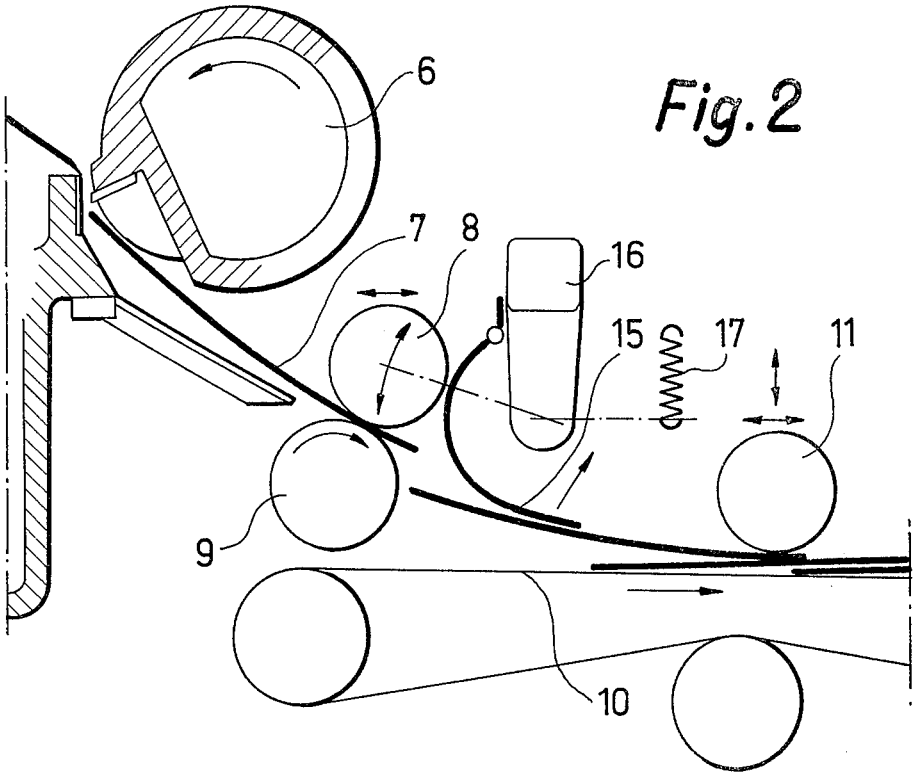
Fig. 2
Fig. 3
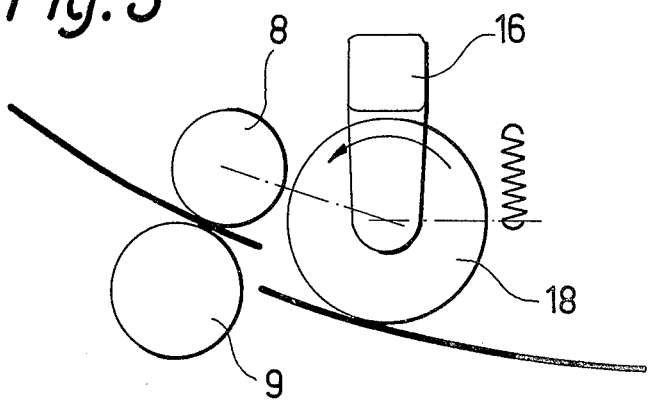

SHEET LAYING APPARATUS

BACKGROUND OF THE INVENTION

1. Field of the Invention

The present invention relates to a sheet cutting and laying apparatus of the type having a cutter for cutting sheets out of a travelling web, a laying station for receiving the sheets, and conveying means between the cutter and the laying station, particularly of the kind operated at high speed such that the velocity of the sheets has to be decelerated between the cutting station and the sheet laying station.

2. Description of the Prior Art

In the prior art the deceleration of the sheets after the cutting roller is accomplished by means of successive conveyors, as for example described in the German patent specification 631,555, whereby the sheet velocity decreases as the sheet is transferred from one conveyor to another so as to provide a suitable throwing velocity for laying the sheet. Such a sheet layer is however complicated and requires much supervision, since a great amount of various conveyor and guide belts are involved. In addition the apparatus requires much space.

The object of the invention is to eliminate the abovementioned disadvantages and to provide a sheet laying apparatus which is of simple construction and reliable.

SUMMARY OF THE INVENTION

According to this invention there is provided a sheet cutting and laying apparatus of the type once described, which further comprises a pair of drive rollers situated after the cutting station and rotated at a linear velocity at least equal to the travelling velocity of the web and means for operating the subsequent conveying means at a velocity lower than that of said pair of drive rollers so as to cause the sheets after the pair of drive rollers to assume a partially overlapping relationship and to be conveyed at a decelerated velocity further to the laying station.

The pair of drive rollers is preferably so located that the leading edge of the sheet has reached the nip between the drive rollers at the moment of transversal cutting.

In the apparatus according to the invention guide means may be arranged after the pair of drive rollers for forcing the drive rollers to throw the trailing edge of the sheet downward so as to enable the leading edge of the next sheet freely to pass the trailing edge of the preceding sheet above the same.

BRIEF DESCRIPTION OF THE DRAWINGS

FIG. 2 shows, also in elevation, a detail of the apparatus; and

FIG. 3 shows another embodiment of the detail shown in FIG. 2.

DESCRIPTION OF THE PREFERRED EMBODIMENTS

Figure 1:
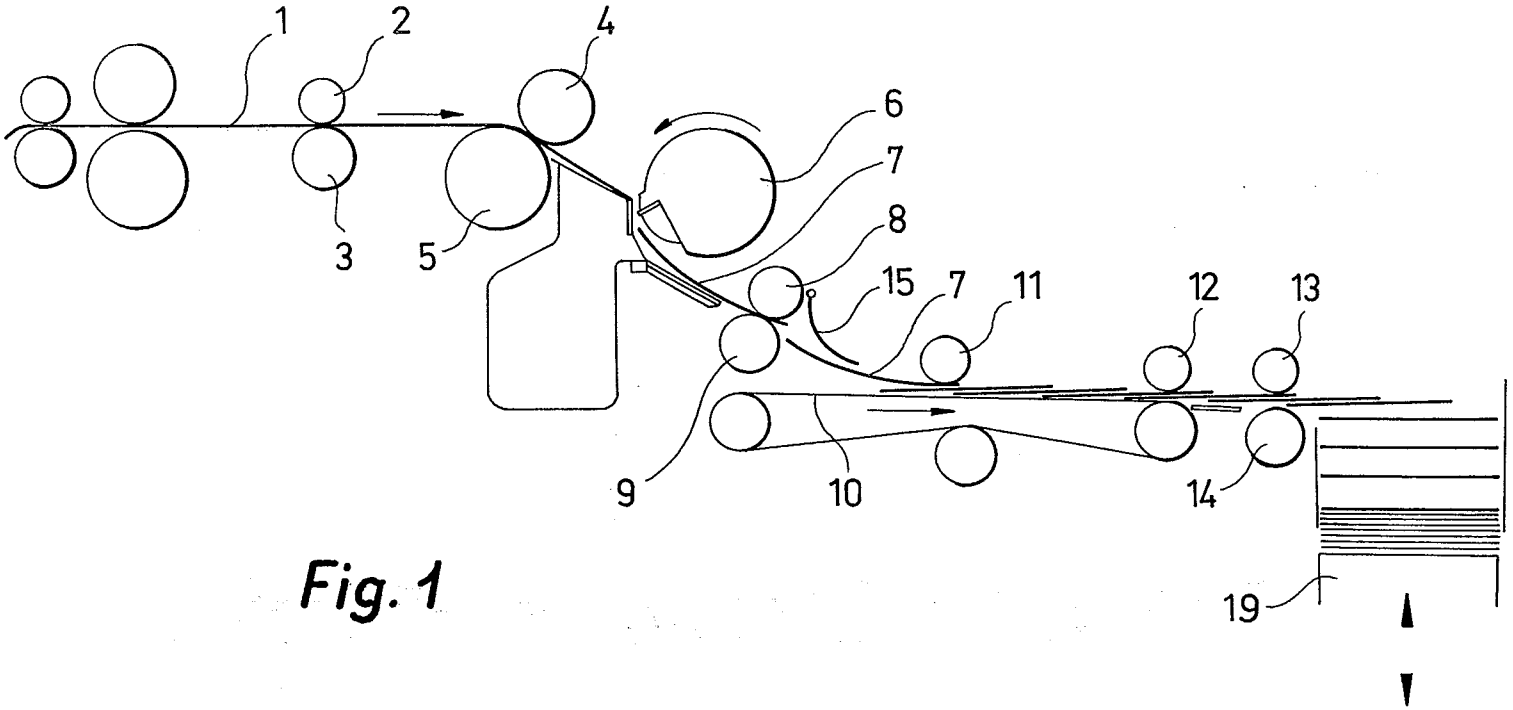
FIG. 1 is an elevational view showing schematically a first embodiment of the sheet laying apparatus according to the invention.

Referring to the drawing, FIG. 1 shows a web 1 travelling in the direction indicated by the arrow from left to right, driven by drive rollers 4, 5. The web is slit longitudinally by means of slitter blades 2, 3, and transversally by means of a cutter blade 6, thus providing a sheet 7 which, thrown by a pair of drive rollers 8, 9 and guided by a guide plate 15, travels under a pressure roller 11.

During the transversal cutting step the leading edge of the sheet is situated between the pair of drive rollers 8, 9 running at a slightly higher linear velocity than that of the pair of drive rollers 4, 5. The drive rollers 8, 9 direct the sheet 7 to a conveyor belt 10 in the direction of the common tangent of the rollers. The guide plate 15 presses the trailing edge downward so as to enable the leading edge of the next following sheet to move over the trailing edge of the preceding one. The velocity of the conveyor 10 is substantially lower than that of the feeding velocity of the rollers 8, 9, so that the sheets are placed on the conveyor in an overlapping relation. The location of the pressure roller 11 is so chosen that the leading edge of the sheet just will reach the nip of the pressure roller as its trailing edge is released from the nip of the pair of drive rollers 8, 9. From the conveyor 10 the sheets travel at a constant velocity under a pressure roller 12 and between drive rollers 13, 14, and fall down onto a layboy 19 where they form a pile of sheets.

FIG. 2 shows the drive roller 8 mounted pivotedly on a beam 16, spring loaded by means of a spring 17. The guide plate 15 is also mounted on the beam 16 so as to be able to swing upward from the position shown either freely or resiliently. The beam with the roller, the guide plate, and the spring, is horizontally adjustable, by means not shown, whereby the nip between the rollers 8, 9 is displaced and the direction of the sheet is changed. The pressure roller 11 is adjustable both horizontally and vertically.

An alternative embodiment is shown in FIG. 3. Here a roller 18, rotatably mounted on the beam 16, serves for guiding the sheet.

The velocity of the conveyor, being adjustable, is chosen so as to give the sheets a throwing motion suitable in view of pile formation. It has been found in practice that said velocity preferably should be in the range of from 60 to 120 meters per minute. The running speed of the pulp machine may be considerably higher. In an exemplary instance the ratio of the velocity of the rollers 4, 5 to that of the rollers 8, 9 was 1:1.2 and the ratio of the velocity of the rollers 4, 5 to that of the conveyor was 1:0.3. It is to be appreciated that in some cases when the running speed of the pulp machine is low, the velocity of the conveyor may exceed the web velocity at the rollers 4, 5.

The apparatus according to the invention provides a simple means for arranging the sheets in overlapping relation.

What is claimed is:

1. In a sheet laying apparatus having a cutter for cutting sheets from a travelling web, a laying station for receiving the sheets in stacked order, and means for conveying the sheets from the cutter to the laying station, the improvement which comprises a pair of rollers driven at a peripheral velocity at least equal to the travelling velocity of the web, a conveyor driven at a velocity lower than the peripheral velocity of said rollers, and guide means, said pair of rollers being positioned to grip each successive sheet cut from the web and to advance the sheet onto said conveyor, said guide means being positioned to engage the sheet advanced by said rollers and deflect the trailing edge of the sheet toward the conveyor to enable the leading edge of the next following sheet to pass over the trailing edge of the preceding sheet whereby the sheets are placed upon the conveyor in overlapping relation for conveyance thereby to the laying station, at least one of said drive rollers being adjustable for varying the sheet throwing direction, said guide means being adjustable automatically in connection with the drive rollers.

* * * * *